US007310070B1

(12) United States Patent
Hardman et al.

(10) Patent No.: US 7,310,070 B1
(45) Date of Patent: Dec. 18, 2007

(54) RADIO FREQUENCY IDENTIFICATION SHELF ANTENNA WITH A DISTRIBUTED PATTERN FOR LOCALIZED TAG DETECTION

(75) Inventors: Gordon E. Hardman, Boulder, CO (US); John W. Pyne, Erie, CO (US); Gary L. Overhultz, River Forest, IL (US)

(73) Assignee: Goliath Solutions, LLC, Deerfield, IL (US)

( * ) Notice: Subject to any disclaimer, the term of this patent is extended or adjusted under 35 U.S.C. 154(b) by 0 days.

(21) Appl. No.: 11/508,466

(22) Filed: Aug. 23, 2006

(51) Int. Cl.
*H01Q 11/12* (2006.01)

(52) U.S. Cl. ..... 343/742; 343/867; 340/10.1; 340/572.1

(58) Field of Classification Search ..... 343/742, 343/867, 700 MS; 340/572.1, 10.1
See application file for complete search history.

(56) References Cited

U.S. PATENT DOCUMENTS 5,287,266 A 2/1994 Malec et al.
5,583,819 A 12/1996 Roesner et al.
5,583,850 A 12/1996 Snodgrass et al.
5,640,683 A 6/1997 Evans et al.
5,745,036 A 4/1998 Clare
5,771,005 A 6/1998 Goodwin, III
5,774,876 A 6/1998 Woolley et al.
5,776,278 A 7/1998 Tuttle et al.
5,894,266 A 4/1999 Wood, Jr. et al.
5,910,776 A 6/1999 Black
5,920,261 A 7/1999 Hughes et al.
5,923,252 A 7/1999 Sizer et al.
5,936,527 A 8/1999 Isaacman et al.
5,949,335 A 9/1999 Maynard
5,955,951 A 9/1999 Wischerop et al.
5,959,568 A 9/1999 Woolley
5,963,134 A 10/1999 Bowers et al.

(Continued)

FOREIGN PATENT DOCUMENTS

WO WO 2004/086337 A2 10/2004

OTHER PUBLICATIONS

Oblivion, Brian et al., "A 2.4 Ghz Vertical Collinear Antenna for 802.11 Applications", file:///C:/Intellectual%20Property/Shelf%20Antenna/24collinear.html (12 pp.), no date available.

(Continued)

*Primary Examiner*—Hoang V. Nguyen
(74) *Attorney, Agent, or Firm*—Jones Day

(57) ABSTRACT

In accordance with the teachings described herein, an RFID antenna system is provided for detecting RFID tags on a display structure. The antenna system may include an antenna having an elongated conductor extending from a feeding point to a grounding point in a configuration that defines at least two loops and that has at least two conductor sections crossing each other at an intersection location between two adjacent loops, with a dielectric interposed between the conductor sections at the intersection location. The antenna may be attached to the display structure and may be located at a position on the display structure in relation to a reflective plane that allows the antenna to have a directional longitudinal radiation pattern that radiates into an area of the display structure that is configured to support a displayed item with an attached RFID tag.

43 Claims, 7 Drawing Sheets

U.S. PATENT DOCUMENTS 5,964,656 A 10/1999 Lawler, Jr. et al.
5,974,368 A 10/1999 Schepps et al.
6,002,344 A 12/1999 Bandy et al.
6,005,482 A 12/1999 Moran et al.
6,013,949 A 1/2000 Tuttle
6,025,780 A 2/2000 Bowers et al.
6,037,879 A 3/2000 Tuttle
6,043,746 A 3/2000 Sorrells
6,045,652 A 4/2000 Tuttle et al.
6,061,614 A 5/2000 Carrender et al.
6,070,156 A 5/2000 Hartsell, Jr.
6,078,888 A 6/2000 Johnson, Jr.
6,084,530 A 7/2000 Pidwerbetsky et al.
6,091,319 A 7/2000 Black et al.
6,097,301 A 8/2000 Tuttle
6,100,790 A 8/2000 Evans et al.
6,104,279 A 8/2000 Maletsky
6,107,917 A 8/2000 Carrender et al.
6,109,568 A 8/2000 Gilbert et al.
6,121,878 A 9/2000 Brady et al.
6,121,880 A 9/2000 Scott et al.
6,127,917 A 10/2000 Tuttle
6,127,928 A 10/2000 Issacman et al.
6,133,836 A 10/2000 Smith
6,137,403 A 10/2000 Desrochers et al.
6,148,291 A 11/2000 Radican
6,150,921 A 11/2000 Werb et al.
6,150,934 A 11/2000 Stiglic
6,150,948 A 11/2000 Watkins
6,169,483 B1 1/2001 Ghaffari et al.
6,177,861 B1 1/2001 MacLellan et al.
6,195,005 B1 2/2001 Maloney
6,195,006 B1 2/2001 Bowers et al.
6,198,392 B1 3/2001 Hahn et al.
6,204,764 B1 3/2001 Maloney
6,212,401 B1 4/2001 Ackley
6,215,403 B1 4/2001 Chan et al.
6,220,516 B1 4/2001 Tuttle et al.
6,229,445 B1 5/2001 Wack
6,232,870 B1 5/2001 Garber et al.
6,236,315 B1 5/2001 Helms et al.
6,246,882 B1 6/2001 Lachance
6,249,227 B1 6/2001 Brady et al.
6,253,190 B1 6/2001 Sutherland
6,260,049 B1 7/2001 Fitzgerald et al.
6,262,662 B1 7/2001 Back et al.
6,265,962 B1 7/2001 Black et al.
6,265,963 B1 7/2001 Wood, Jr.
6,269,342 B1 7/2001 Brick et al.
6,272,457 B1 8/2001 Ford et al.
6,298,591 B1 10/2001 Healy
6,304,856 B1 10/2001 Soga et al.
6,308,177 B1 10/2001 Israni et al.
6,308,446 B1 10/2001 Healy
6,312,106 B1 11/2001 Walker
6,360,138 B1 3/2002 Coppola et al.
6,369,712 B2 4/2002 Letkomiller et al.
6,405,102 B1 6/2002 Swartz et al.
6,577,238 B1 6/2003 Whitesmith et al.
6,580,358 B1 6/2003 Nysen
6,650,230 B1 11/2003 Evans et al.
6,826,554 B2 11/2004 Sone
6,861,993 B2 * 3/2005 Waldner ..... 343/742
7,154,449 B2 * 12/2006 Liu et al. ..... 343/867
2001/0000430 A1 4/2001 Smith et al.
2001/0001553 A1 5/2001 Hahn et al.
2001/0004236 A1 6/2001 Letkomiller et al.
2001/0054959 A1 12/2001 Van Horn
2002/0140546 A1 10/2002 Tuttle
2002/0149468 A1 10/2002 Carrender
2002/0149480 A1 10/2002 Shanks et al.
2002/0149481 A1 10/2002 Shanks et al.
2002/0149482 A1 10/2002 Shanks et al.
2002/0149483 A1 10/2002 Shanks et al.
2003/0141962 A1 * 7/2003 Barink ..... 340/10.42
2004/0015417 A1 1/2004 Youngman et al.
2004/0056091 A1 3/2004 Overhultz et al.
2004/0183742 A1 * 9/2004 Goff et al. ..... 343/867
2005/0040934 A1 * 2/2005 Shanton ..... 340/5.92

OTHER PUBLICATIONS

"Build A 9 dB, 70cm, Collinear Antenna From Coax", http://www.rason.org/Projects/collant/collant.html (3 pp.), no date avail.

* cited by examiner

RADIO FREQUENCY IDENTIFICATION SHELF ANTENNA WITH A DISTRIBUTED PATTERN FOR LOCALIZED TAG DETECTION

FIELD

This technology relates generally to radio frequency identification (RFID) systems.

BACKGROUND AND SUMMARY

RFID systems are often used to identify and monitor items stocked in a retail environment. The use of an RFID system to determine what items are displayed on a particular shelf or other display structure, however, may present unique challenges. For instance, it is often challenging to detect which items are displayed on a particular shelf without also detecting other RFID tags in close proximity, such as on an adjacent shelf.

In accordance with the teachings described herein, an RFID antenna system is provided for detecting RFID tags on a display structure. The antenna system may include an antenna having an elongated conductor extending from a feeding point to a grounding point in a configuration that defines at least two loops and that has at least two conductor sections crossing each other at an intersection location between two adjacent loops, with a dielectric interposed between the conductor sections at the intersection location. The antenna may be attached to the display structure and may be located at a position on the display structure in relation to a reflective plane that allows the antenna to have a directional longitudinal radiation pattern that radiates into an area of the display structure that is configured to support a displayed item with an attached RFID tag.

DETAILED DESCRIPTION

Figure 1:
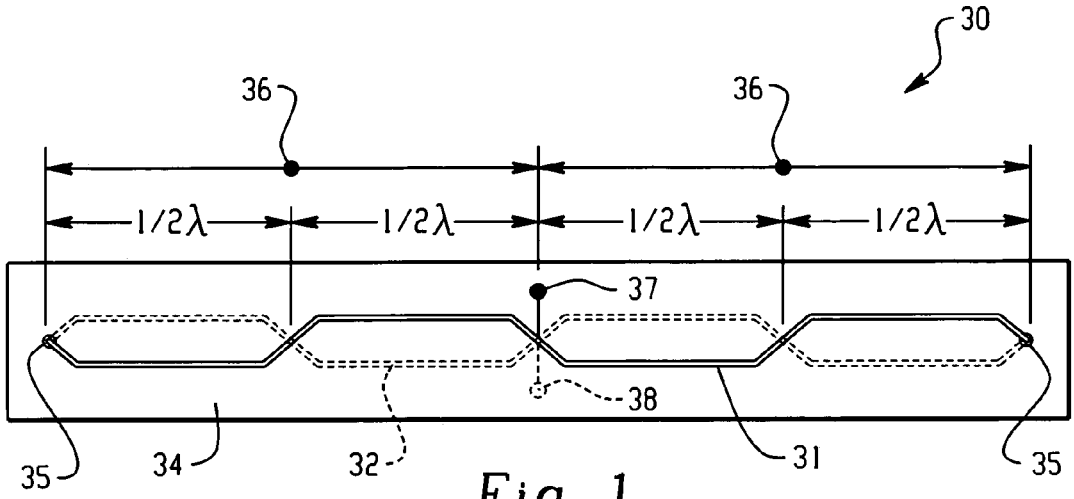
FIG. 1 is a diagram of an RFID shelf antenna.

FIG. 1 is a diagram of an example RFID shelf antenna 30. The antenna 30 includes an antenna having an elongated conductor 31, 32 that is disposed on a dielectric 34. The antenna conductor includes a first conductor section 31 that is disposed on a front surface of the dielectric 34 and a second conductor section 32 that is disposed on a rear surface of the dielectric 34. Portions of the antenna 30 disposed on the rear surface of the dielectric 34 are illustrated with dashed lines in FIG. 1.

The antenna conductor 31, 32 includes two radiating arms 36 extending in different directions from a common antenna feeding point 37 on the front surface of the dielectric 34 to a common grounding point 38 on the rear surface of the dielectric. More specifically, the first conductor section 31 extends in opposite directions from the feeding point 37 to junction points 35. At the junction points 35, the first conductor section 31 makes electrical connection through the dielectric 34 with the second conductor section 32. The second conductor section 32 extends from the junction points 35 to the grounding point 38 on the rear surface of the dielectric 34. The feeding point 37 and grounding point 38 are separated by the dielectric 34 at an intersection location that is located equidistant between the two junction points 35.

Each radiating arm 36 of the antenna defines at least two loops with the first and second conductor sections 31, 32 crossing each other (electrically separated by the dielectric 34) at intersection locations between adjacent loops. Each loop has a length that is equal to one half of an operational wavelength of the antenna. In a preferred example, the radiating arms 36 extend in substantially opposite directions from the feeding point 37 and grounding point 38 in order to form a collinear antenna with a distributed radiation pattern along its length.

In the illustrated example, each radiating arm 36 forms two loops. In other examples, however, more or less loops could be formed by each radiating arm 36. For instance, the example depicted in FIG. 2B includes three loops formed by each radiating arm. In this manner, additional loops may be added to increase the overall length of the antenna. It should be understood, however, that the radiation pattern toward the endpoints of the antenna will become progressively weaker as additional loops are added to the radiating arms 36.

The antenna conductor 31, 32 is fabricated, printed or otherwise disposed on a dielectric material 34. The dielectric material 34 may, for example, be fiberglass (e.g., FR4 fiberglass), ceramic or some other suitable type of dielectric material. In certain embodiments, for example, the antenna conductor 31, 32 may be disposed on a printed circuit board, hybrid circuit board or flexible substrate material. In the illustrated example, the antenna conductor includes a first conductor section that is disposed on a front surface of the dielectric 34 and a second conductor section 32 that is disposed on the rear surface of the dielectric 34. In other examples, however, the entire conductor 31, 32 may be disposed on the same surface, so long as the conductor sections 31, 32 are electrically isolated from each other at the intersection locations between adjacent loops. For example, a dielectric material may be disposed between the conductor sections 31, 32 only at the intersection locations, with the conductor sections 31, 32 being otherwise disposed on the same surface.

Figure 2A:
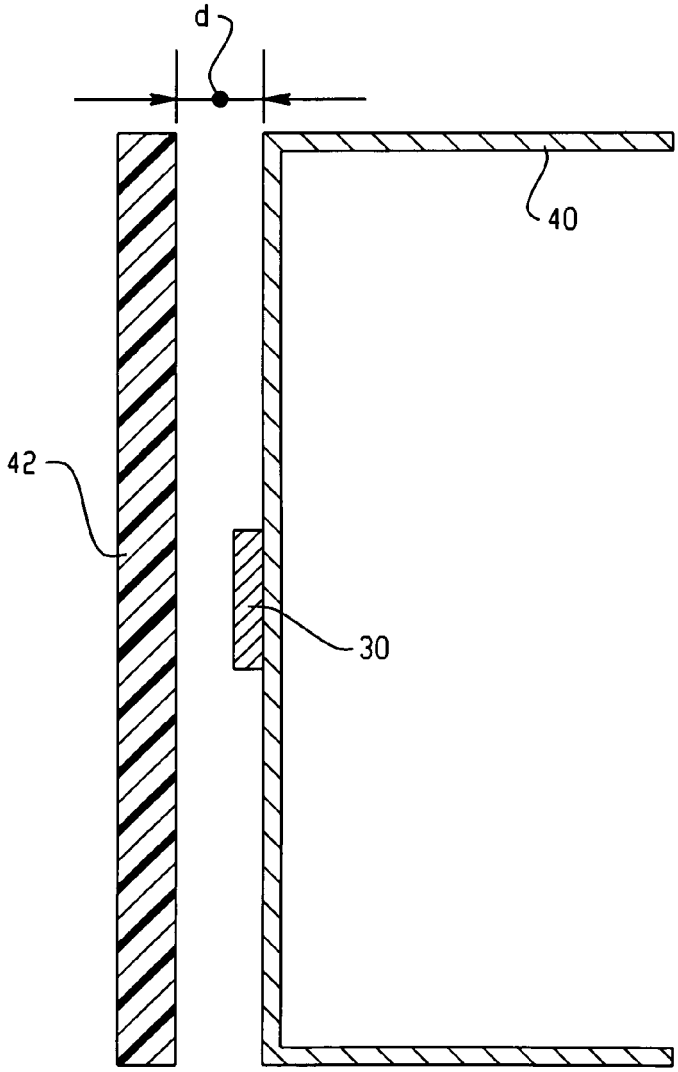
FIGS. 2A and 2B illustrate a retail display structure, such as a shelf, that utilizes the RFID shelf antenna of FIG. 1.
Figure 2B:
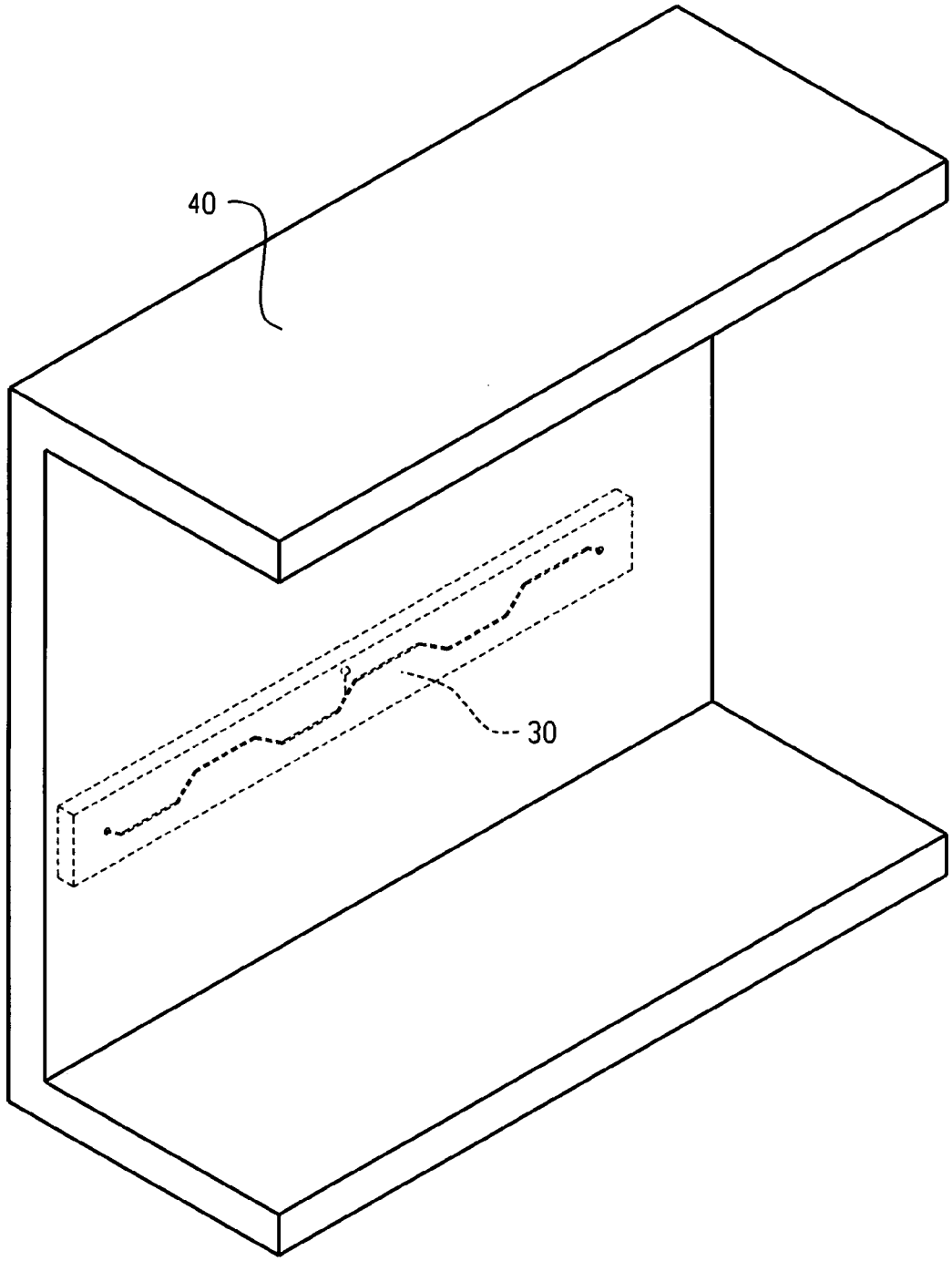

FIG. 2A illustrates a cross-sectional diagram of a retail display structure 40, such as a shelf, that utilizes the RFID shelf antenna 30 of FIG. 1. As illustrated in the frontal view of the retail display structure 40 depicted in FIG. 2B, the antenna 30 is attached lengthwise along the shelf 40 such that the antenna will provide a distributed radiation pattern along the length of the shelf 40. Referring again to FIG. 2A, the display structure 40 also includes a reflective plane 42 located behind the display area. The reflective plane 42 isolates the radiation pattern of the antenna 30 to help prevent the antenna from radiating beyond the reflective plane 42 toward the rear of the display structure 40. In this manner, the radiation pattern of the antenna 30 is directed along the length of the display structure 40 and into the display area. The reflective plane 42 may be fabricated from any suitable material that reflects electromagnetic waves, such as aluminum.

FIG. 2A also illustrates that the reflective plane 42 may be positioned at a distance (d) from the antenna 30. The distance (d) may be varied to tune the impedance of the antenna.

Figure 3:
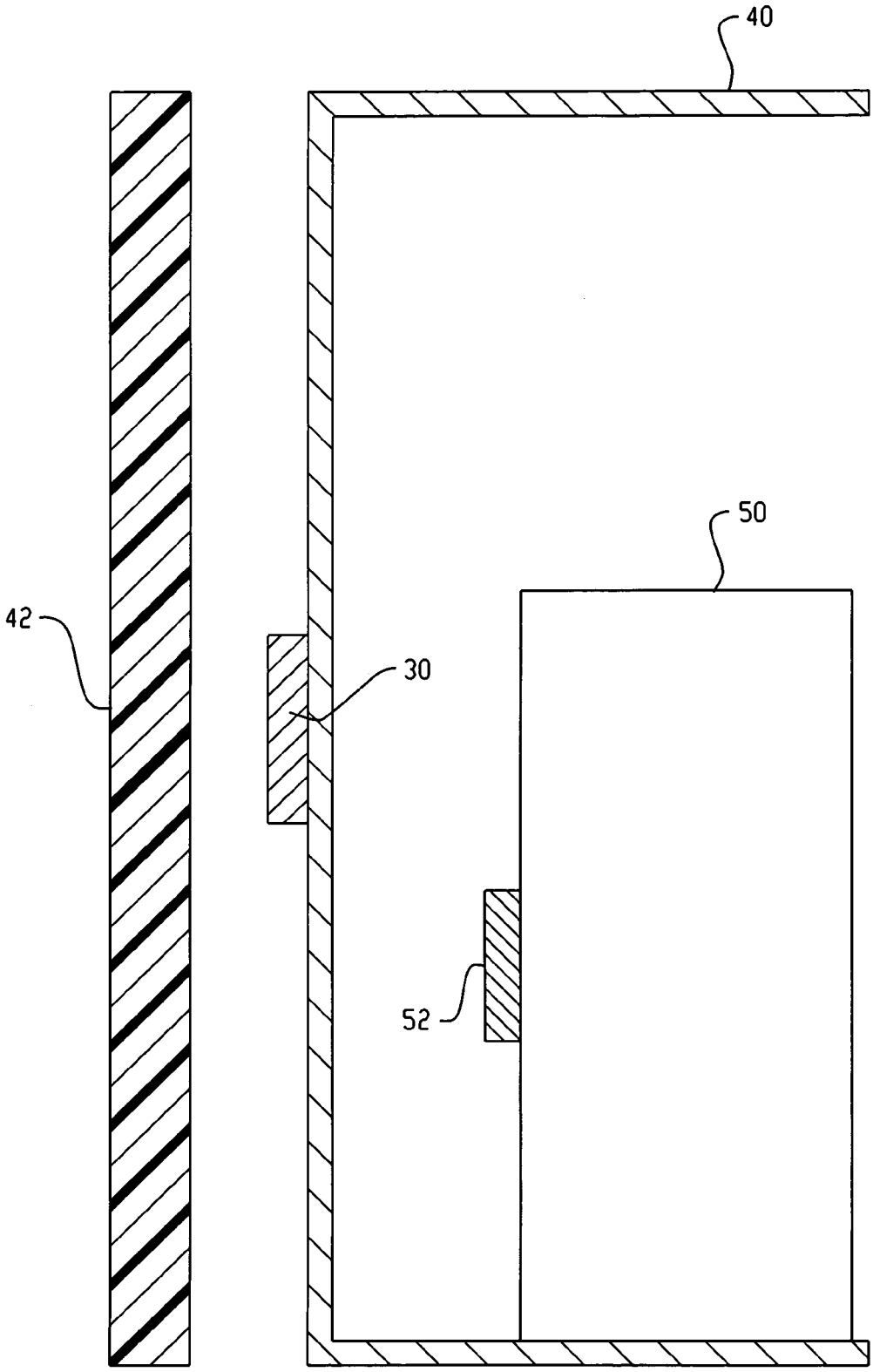
FIG. 3 illustrates an item with an attached RFID tag displayed on the display structure of FIGS. 2A and 2B.

As illustrated in FIG. 3, the display area of the display structure 40 is configured to support a displayed item 50 with an attached RFID tag 52. The displayed item 50 may be an individual item, a package of items, or some other type or configuration of displayed item(s) having an attached RFID tag 52. For instance, RFID tags 52 may be attached to individual retail products or to packages of retail products, such as PDQ product trays. In operation, the localized and directed radiation pattern provided by the RFID shelf antenna 30 may be used to detect the displayed item 50 on the shelf, without inadvertently detecting items on other nearby display structures, such as adjacent shelves.

The RFID tags 52 may be passive tags, active tags or semi-passive tags. In the case of a passive or semi-passive tag, the RFID shelf antenna 30 may operate in combination with one or more transmission antennas, for example as described in commonly-assigned U.S. Pat. No. 6,837,427 and U.S. patent application Ser. No. 11/417,768, both of which are incorporated herein by reference in their entirety.

Figure 4:
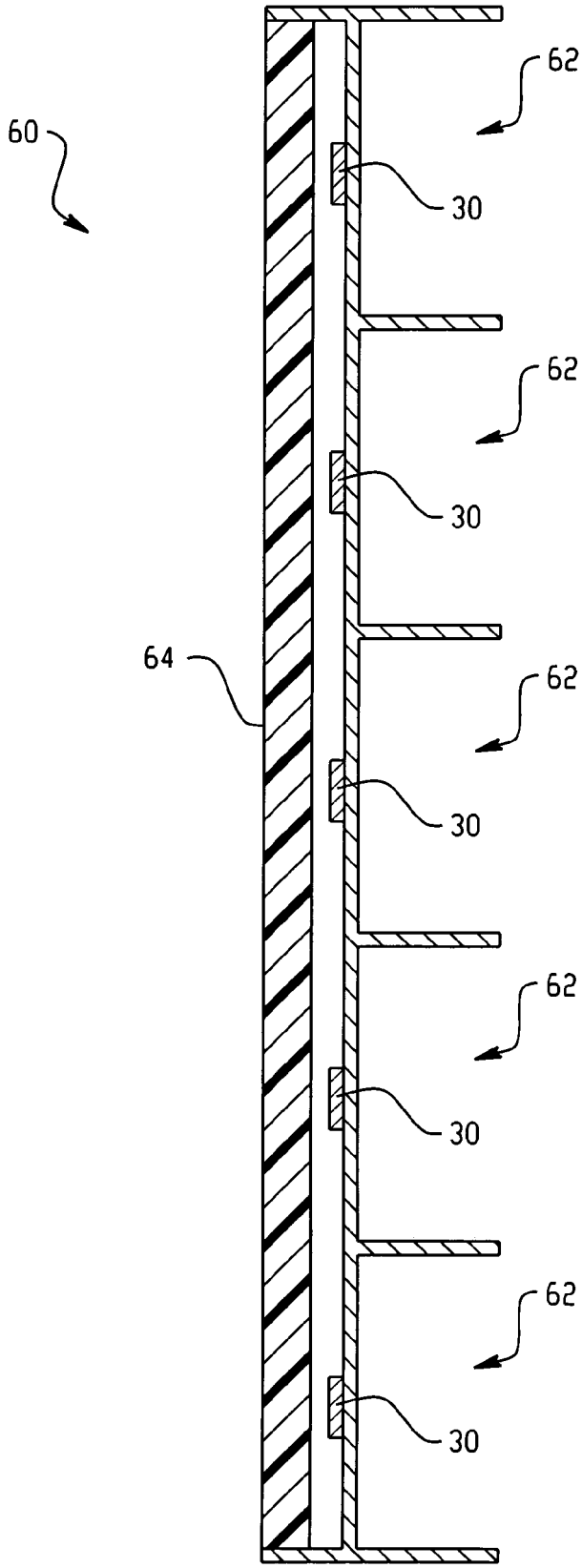
FIG. 4 is a cross-sectional diagram of an example retail shelving unit that includes an RFID shelf antenna on the rear wall of each shelf.

FIG. 4 is a cross-sectional diagram of an example retail shelving unit 60 that includes an RFID shelf antenna 30 behind the rear wall of each shelf 62. An antenna 30 is attached lengthwise along the back wall of individual shelves (not shown in FIG. 4), or a common wall to which individual shelves 62 may be affixed (either permanently or removably.) The antennas 30 each provide a distributed radiation pattern along the length of the respective shelf 62. In addition, a reflective plane 64 is positioned behind the rear wall of the shelves 62 at a distance (d) from the antenna 30 to help localize the antenna radiation patterns in the display areas of the shelving unit 60 and to help prevent the antennas 30 from detecting RF tags located behind the shelving unit 60.

Figure 5:
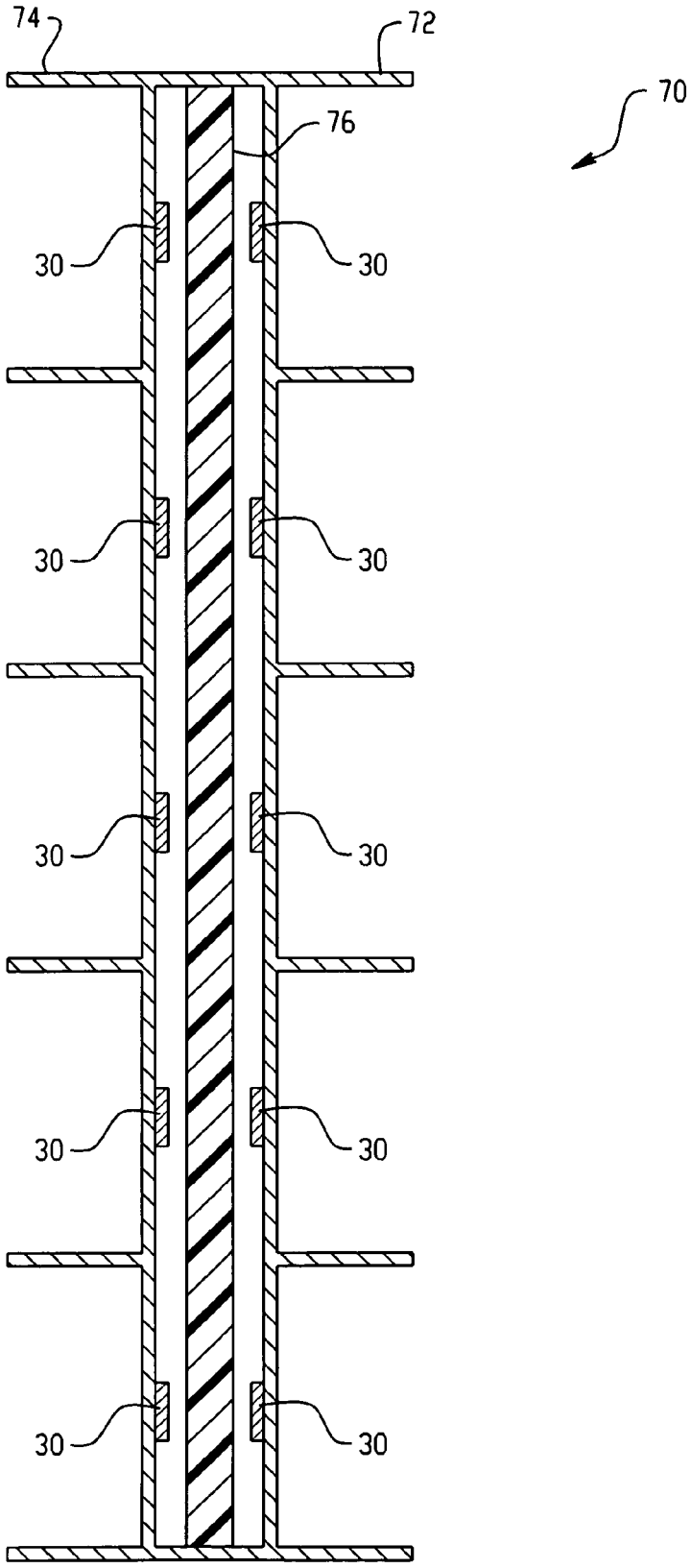
FIG. 5 is a cross-sectional diagram of another example retail shelving unit that includes an RFID shelf antenna on the rear wall of each shelf.

FIG. 5 is a cross-sectional diagram of another example retail shelving unit 70 that includes an RFID shelf antenna 30 attached behind the rear wall of each respective shelf. In this example, the unit 70 includes a forward-facing set of shelves 72 and a rear-facing set of shelves 74. The forward- and rear-facing shelves 72, 74 are isolated from each other by a reflective plane 76. The reflective plane 76 helps to prevent the localized radiation pattern of an antenna 30 on a forward-facing shelf 72 from interfering with the operation of an antenna 30 on a rear-facing shelf 74, and vice versa.

Figure 6:
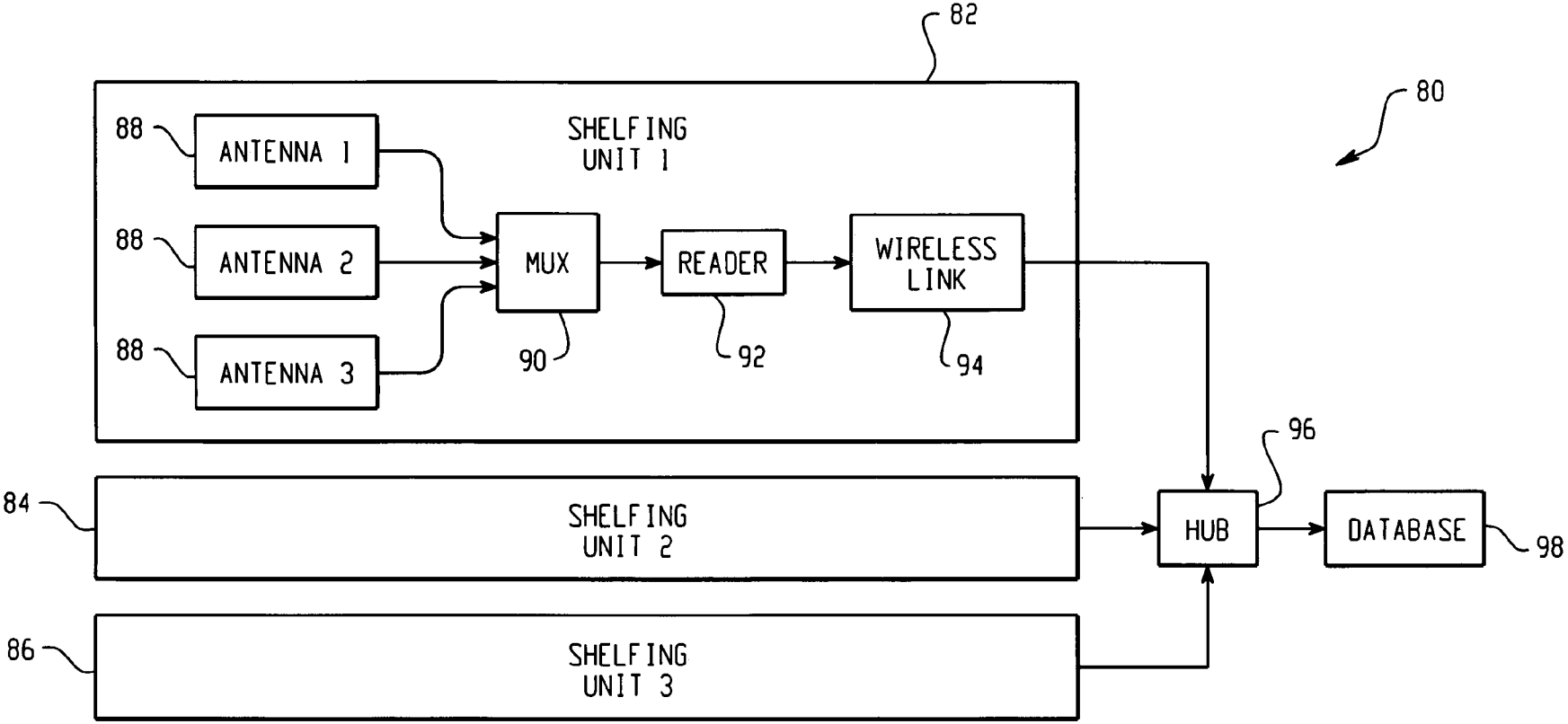
FIG. 6 is a block diagram of an example RFID system.

FIG. 6 is a block diagram of an example RFID system 80. The system 80 includes a plurality of shelving units 82, 84, 86. Each shelving unit 82, 84, 86 includes a plurality of RFID shelf antennas 88, for example as described above with reference to FIGS. 1-5. As described above, the RFID shelf antennas 88 provide localized, longitudinal radiation patterns that are configured to detect signals from RFID tags that are placed on an associated shelf in the shelving unit 82, 84, 86. The signals received by the plurality of antennas 88 in each shelving unit 82 are encoded into a single transmission signal by a multiplexer 90, and the multiplexed transmission signal for the shelving unit is directed to an RFID reader 92 for processing.

The RFID reader 92 processes the multiplexed transmission signal to detect the presence of RFID tags located on the shelves. Each RFID tag, for example, may be programmed with a unique identification number and/or other information relating to its associated product(s). The unique identification number and/or other information from a detected RFID tag is received by the RFID reader 92 via the multiplexed transmission signal, and this information is transmitted over a wireless link 94 to a central hub 96. The data received by the RFID reader 92 may also indicate which specific antenna 88 received the RFID tag information, such that the received data may be used to determine on which specific shelf a tagged item is stocked. The central hub 96 receives similar information from each of the plurality of shelving units 82, 84, 86, and records the information in a central database 98.

The central hub 96 may, for example, record all of the detected RFID data from a single retail environment. In other examples, however, the central hub 96 may record RFID data for multiple facilities, or may record RFID data for smaller areas within a facility. For instance, in one example the central hub 96 may receive and record RFID data from multiple facilities over a computer network or other communication system. In another example, a single facility may have multiple central hubs 96, such as one hub for each department in a retail facility. Also, in certain examples, the RFID readers 92 may communicate with the central hub 96 using one or more types of communication links other than or in addition to a wireless link 94. For instance, the RFID readers 92 may communicate with the central hub 96 over a computer network, a telephone network and/or some other type of communication network.

This written description uses examples to disclose the invention, including the best mode, and also to enable a person skilled in the art to make and use the invention. The patentable scope of the invention may include other examples that occur to those skilled in the art. Also the term "equal," as used herein, refers to a range of values that are either exactly equivalent or that differ by an insubstantial amount.

Figure 7:
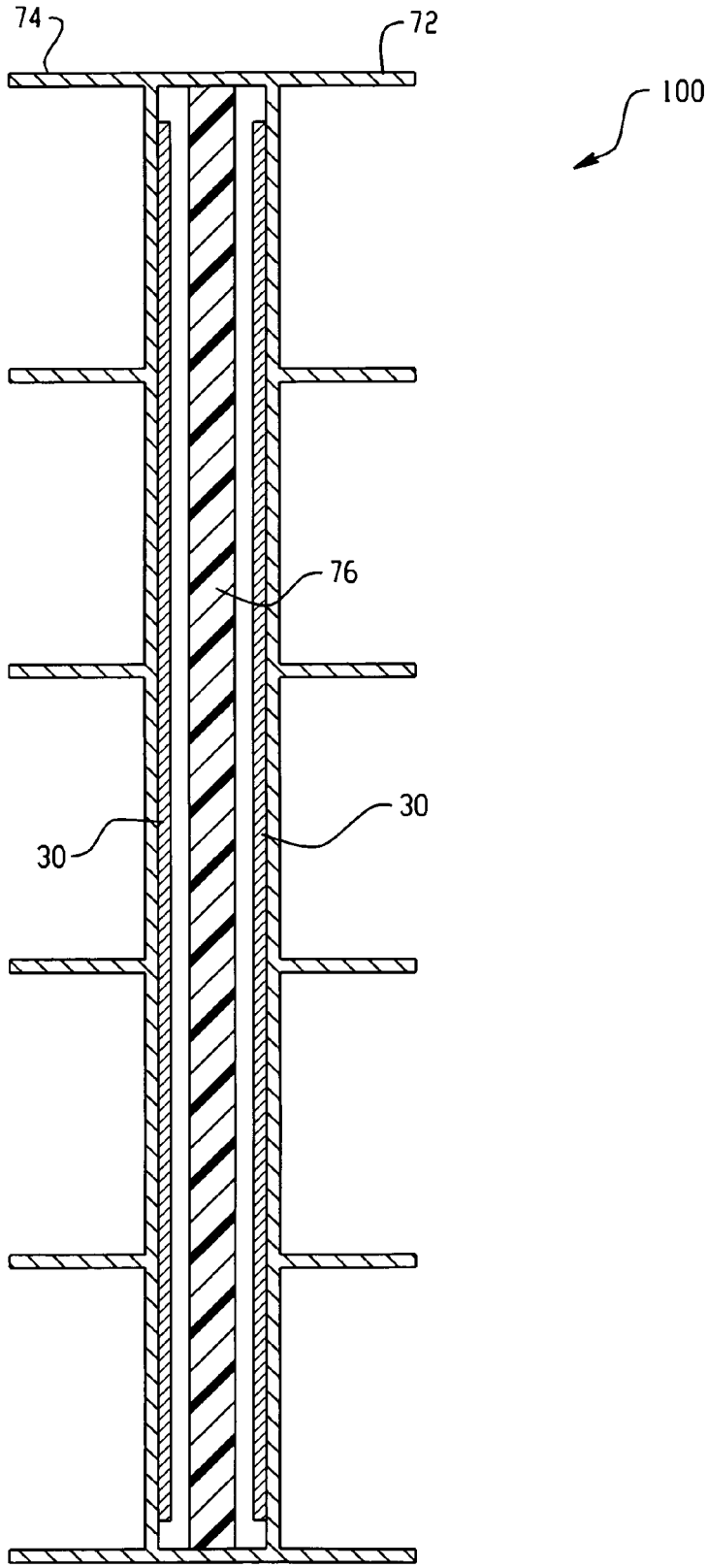
FIG. 7 illustrates another example RFID shelf antenna configuration.

One alternative example is illustrated in FIG. 7. In this example, the antennas 30 are attached vertically behind the rear wall and spanning across multiple shelves of a shelving unit 100. The shelving unit 100 includes a forward-facing set of shelves 72 and a rear-facing set of shelves 74, which are isolated from each other by a reflective plane 74. A single antenna 30 (or plural antennas connected in series) is attached vertically across the rear of the shelves on each of the forward- and rear-facing shelves. In this manner, the antennas 30 may be used in an RFID system to distinguish tagged items that are stocked on the forward-facing shelves from tagged items that are stocked on the rear-facing shelves.

Also, the RFID shelf antennas described herein may be used singly or in combination to cover specified key proximal areas of a large and/or multi-faceted location where merchandising material may be displayed. These include, but are not limited to, long shelves, multi-side display holders, multiple shelves, immediately-adjacent side areas, and special signage holders.

An advantage of the RFID shelf antennas is their ability to efficiently pick up RFID tags that can appear in any number of positions along the major axis of the antenna. In addition, the ability of this antenna to cover a broad area while being insulated from adjacent areas provides an advantage over other antenna designs.

In certain examples, the RFID shelf antenna may be used to detect that particular items are co-located within a space (e.g., to detect that a peanut butter display is adjacent to a jelly display.) In addition, with a series of such antennas, it may be determined that a particular item is located in a relatively specific location (e.g., at an adult eye-level vs. close to the floor.) When rotated to a vertical position, as depicted in the example of FIG. 7, these antennas can efficiently and effectively monitor RFID-tagged contents across shelves on a particular-facing side of a multi-sided display or merchandising material holder. For example, it may be valuable to distinguish what merchandise is facing a customer at a checkout line as the customer approaches the cashier area compared to when the customer is standing directly in front of the cashier. Other example uses and advantages of the RFID shelf antennas are also contemplated.

It is claimed:

1. A radio frequency identification (RFID) antenna system for detecting RFID tags on a display structure, comprising:

an antenna having an elongated conductor extending from a feeding point to a grounding point in a configuration that defines at least two loops and that has at least two conductor sections crossing each other at an intersection location between two adjacent loops;

a dielectric interposed between the conductor sections at the intersection location; and a reflective plane attached to the display structure;

the antenna being attached to the display structure and having a location at a position on the display structure in relation to the reflective plane that allows the antenna to have a directional longitudinal radiation pattern that radiates into an area of the display structure that is configured to support a displayed item with an attached RFID tag.

2. The RFID antenna system of claim 1, wherein a first half of the elongated conductor is disposed on a first side of the dielectric and a second half of the elongated conductor is disposed on a second side of the dielectric.

3. The RFID antenna system of claim 2, wherein the antenna further includes at least one junction point connecting the first half of the elongated conductor to the second half of the elongated conductor.

4. The RFID antenna system of claim 1, wherein the configuration of the antenna defines at least four loops with the at least two conductor sections crossing each other at least three intersection locations between adjacent loops, and wherein the dielectric is interposed between the conductor sections at each of the at least three intersection locations.

5. The RFID antenna system of claim 4, wherein the feeding and grounding points are located at one of the at least three intersection locations.

6. The RFID antenna system of claim 5, wherein a first half of the at least four loops define a first radiating arm of the antenna and a second half of the at least four loops define a second radiating arm of the antenna.

7. The RFID antenna system of claim 6, wherein the first and second radiating arms extend in different directions from the feeding and grounding points.

8. The RFID antenna system of claim 7, wherein the first and second radiating arms extend in opposite directions from the feeding and grounding points.

9. The RFID antenna system of claim 1, wherein each of the at least two loops has a length that is equal to one half of an operational wavelength of the antenna.

10. The RFID antenna system of claim 4, wherein a first half of the elongated conductor is disposed on a first side of the dielectric and a second half of the elongated conductor is disposed on a second side of the dielectric.

11. The RFID antenna system of claim 4, wherein the antenna further includes a first junction point and a second junction point and wherein the first half of the elongated conductor is connected to the second half of the elongated conductor at the first and second junction points.

12. The RFID system of claim 6, wherein the feeding point is located on the first half of the elongate conductor and the grounding point is located on the second half of the elongated conductor.

13. The RFID system of claim 7, wherein the feeding and grounding points are located at one of the at least three intersection locations and are substantially equidistant between the first junction point and the second junction point.

14. The RFID antenna system of claim 1, wherein the antenna is attached to the display structure at a distance from the reflective plane, the distance being selected to tune the impendence of the antenna.

15. The RFID antenna system of claim 6, wherein the first and second radiating arms form a collinear antenna.

16. The RFID antenna system of claim 1, wherein the dielectric is a printed circuit board.

17. The RFID antenna system of claim 1, wherein the dielectric is fiberglass.

18. The RFID antenna system of claim 1, wherein the dielectric is a hybrid circuit board.

19. The RFID antenna system of claim 1, wherein the dielectric is a flexible substrate material.

20. The RFID antenna system of claim 1, wherein the dielectric is a ceramic material.

21. The RFID antenna system of claim 1, wherein the display structure is a shelving unit.

22. The RFID antenna system of claim 21, wherein the antenna is one of a plurality of antennas disposed on the shelving unit.

23. The RFID antenna system of claim 22, wherein the reflective plane isolates one or more antennas disposed on a first portion of the shelving unit from one or more antennas disposed on a second portion of the shelving unit.

24. The RFID antenna system of claim 1, wherein the antenna is printed on the dielectric.

25. A radio frequency identification (RFID) system, comprising:

a display structure having a plurality of display areas and including a plurality of RFID antennas with an RFID antenna being disposed on the display structure in relation to each display area;

each RFID antenna having an elongated conductor extending from a feeding point to a grounding point in a configuration that defines at least two loops and that has at least two conductor sections crossing at an intersection location between two adjacent loops with a dielectric disposed between the conductor sections at the intersection location;

the display structure further including a reflective plane that is attached to the display structure at a position in relation to the plurality of antennas that allows each antenna to have a directional longitudinal radiation pattern that radiates into its respective display area.

26. The RFID system of claim 25, wherein each RFID antenna includes two conductor sections, a first conductor section being disposed on a first side of the dielectric and a second conductor section being disposed on a second side of the dielectric, the first and second conductor sections being joined by at least one junction point.

27. The RFID system of claim 25, wherein each RFID antenna defines first and second radiating arms that extend in different directions from the feeding and grounding points, each radiating arm including at least two loops.

28. The RFID system of claim 25, wherein each of the at least two loops has a length that is equal to one half of an operational wavelength of the RFID antenna.

29. The RFID system of claim 25, further comprising:

an RFID reader coupled to the plurality of RFID antennas and configured to process RFID signals received by the plurality of antennas from RFID tags located within the display areas.

30. The RFID system of claim 29, further comprising:

a multiplexer coupled between the plurality of RFID antennas and the RFID reader that multiplexes the plurality of RFID signals received by the plurality of RFID antennas.

31. The RFID system of claim 28, wherein the display structure is one of a plurality of display structures.

32. The RFID system of claim 29, further comprising:

a central hub configured to receive RFID data from the RFID reader; and a communications link configured to transmit the RFID data from the RFID reader to the central hub.

33. The RFID system of claim 30, wherein the central hub receives RFID data from RFID readers associated with each of the plurality of display structures.

34. The RFID system of claim 30, further comprising:

a central database that stored RFID data received by the central hub.

35. The RFID system of claim 29, wherein the plurality of display structures and the central hub are located in a single retail facility.

36. The RFID system of claim 29, wherein at least two of the display structures are located in different retail facilities.

37. The RFID system of claim 35, wherein the central hub is located remotely from the plurality of display structures.

38. The RFID system of claim 25, wherein two or more of the RFID antennas are connected in series.

39. The RFID system of claim 38, wherein the RFID system is configured to use the two or more series connected RFID antennas to determine a location of a displayed item on the display structure.

40. The RFID system of claim 29, wherein the system is configured to use the RFID signals to associate each RFID tag with a particular one of the plurality of antennas in order to determine which one of a plurality of shelves on the display unit each RFID tag is located.

41. A radio frequency identification (RFID) system, comprising:

a display structure having a first side and a second side, the first side of the display structure including one or more first display areas and including a first RFID antenna that is disposed on the display structure in relation to the one or more first display areas, the second side of the display structure including one or more second display areas and including a second RFID antenna that is disposed on the display structure in relation to the one or more second display areas, the first and second RFID antennas each having an elongated conductor extending from a feeding point to a grounding point in a configuration that defines at least two loops and that has at least two conductor sections crossing at an intersection location between two adjacent loops with a dielectric disposed between the conductor sections at the intersection location;

the display structure further including one or more reflective planes that isolate the first RFID antenna from the second RFID antenna.

42. The RFID system of claim 41, wherein the RFID system is configured to determine if a displayed item is located on the first side of the display structure or the second side of the display structure.

43. The RFID system of claim 41, wherein the RFID system includes a first reflective plane that is attached to the display structure in relation to the first RFID antenna to allow the first RFID antenna to have a radiation pattern that radiates into the one or more first display areas and a second reflective plane that is attached to the display structure in relation to the second RFID antenna to allow the second RFID antenna to have a radiation pattern that radiates into the one or more second display areas.

* * * * *